United States Patent [19]

Hug

[11] 4,102,416

[45] Jul. 25, 1978

[54] STABILIZED CONICAL BORING TOOL

[75] Inventor: Hans Albert Hug, Weston, Mass.

[73] Assignee: Foster-Miller Associates, Inc., Waltham, Mass.

[21] Appl. No.: 723,015

[22] Filed: Sep. 13, 1976

[51] Int. Cl.[2] ..... E21B 9/24

[52] U.S. Cl. ..... 175/227; 175/344; 175/353; 175/372

[58] Field of Search ..... 175/227, 228, 344, 353, 175/372, 378, 354, 369, 370; 308/8.2

[56] References Cited

U.S. PATENT DOCUMENTS

| | | | |
|---|---|---|---|
| 2,310,289 | 2/1943 | Hokansor | 175/354 |
| 2,336,337 | 12/1943 | Zublin | 175/370 X |
| 3,977,481 | 8/1976 | Fisk | 175/228 |
| 4,000,783 | 1/1977 | Hug | 308/8.2 |

*Primary Examiner*—Ernest R. Purser
*Assistant Examiner*—William F. Pate, III
*Attorney, Agent, or Firm*—Morse, Altman, Oates & Bello

[57] ABSTRACT

A self-advancing conical boring tool with a tapered frame for supporting roller cutters, each of which has a frusto-conical body with a plurality of teeth randomly disposed about its periphery. Each roller cutter is constrained within a pair of thrust bearings and a pair of self-aligning spherical roller bearings for free rotation about an axis that is both oblique and skewed relative to a longitudinal axis of the tool. A flexible diaphragm is captively held to the frame proximate each roller cutter and forms a pressure compensated chamber for a bearing lubricant, one face of the diaphragm being adjacent a thrust bearing and the other face of the diaphragm being exposed to the environment through a vent.

13 Claims, 8 Drawing Figures

NO SKEW
$\beta = 0$

NEUTRAL SKEW
$\beta = \beta_o$

FORWARD SKEW
$\beta > \beta_o$

STABILIZED CONICAL BORING TOOL

BACKGROUND OF THE INVENTION

1. Field of Invention

The present invention relates to drilling equipment and, more particularly, is directed toward rock boring tools.

2. Description of the Prior Art

Generally, rotary conical roller bits for reaming pilot holes drilled in rock include rotary cutters that are supported in fixed bearings mounted to a frame. The rotary cutters are moved over the surface being cut at substantially right angles to the plane thereof. When roller bits arrive at hard formations, much difficulty is experienced. Advancement of the bit is very slow and the wear on the cutting edges is excessive. The stress on the roller bit is such as to cause a misalignment of the rotary cutters and excessive wear on the bearings which results in premature failure. In addition, a build up of pressure from flushing fluids and cuttings results in contaminants entering the bearings and causing premature failure. A need has arisen for improvements in rotary conical roller bits.

SUMMARY OF THE INVENTION

It is an object of the present invention to provide a self-advancing conical boring tool organized about a tapered frame and characterized by frusto-conical roller cutters, the periphery of each being provided with a plurality of randomly disposed teeth. Each cutter is rotatably supported at its ends by a self-aligning spherical roller bearing. A thrust bearing is provided at each roller bearing for supporting axial thrust loads on the cutters. The roller cutters are circumferentially disposed about a centerline of the boring tool, each roller cutter constrained for free rotation about an axis that is both oblique and skewed with respect to a longitudinal axis of the frame. Stub shafts extend outwardly from opposite ends of each roller cutter, the shafts being coaxial with the roller cutter rotational axis. The extending shafts are snugly received within the self-aligning spherical roller bearings and the thrust bearings. The relative orientation of each roller cutter and the frame is such that the roller cutters are self-advancing as the boring tool is rotated. A flexible diaphram is captively held about an exposed face of an upper thrust bearing and forms a pressure compensated chamber for a bearing lubricant between one face of the diaphram and the thrust bearing, a vent communicates with the other face of the diaphram and the exterior surface of the frame.

Other objects of the present invention will in part be obvious and will in part appear hereinafter.

The invention accordingly comprises the devices, together with their parts, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENT

Figure 1:
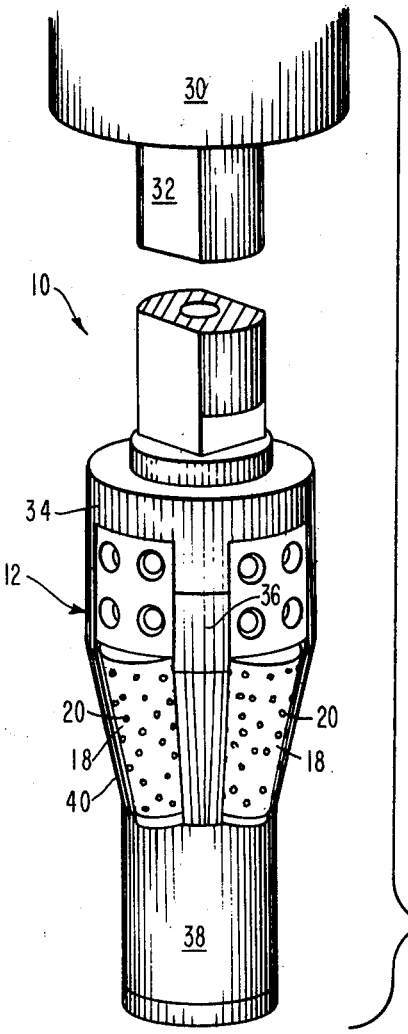
FIG. 1 is a perspective view of rotary drilling system which includes a conical boring tool embodying the present invention.
Figure 3:
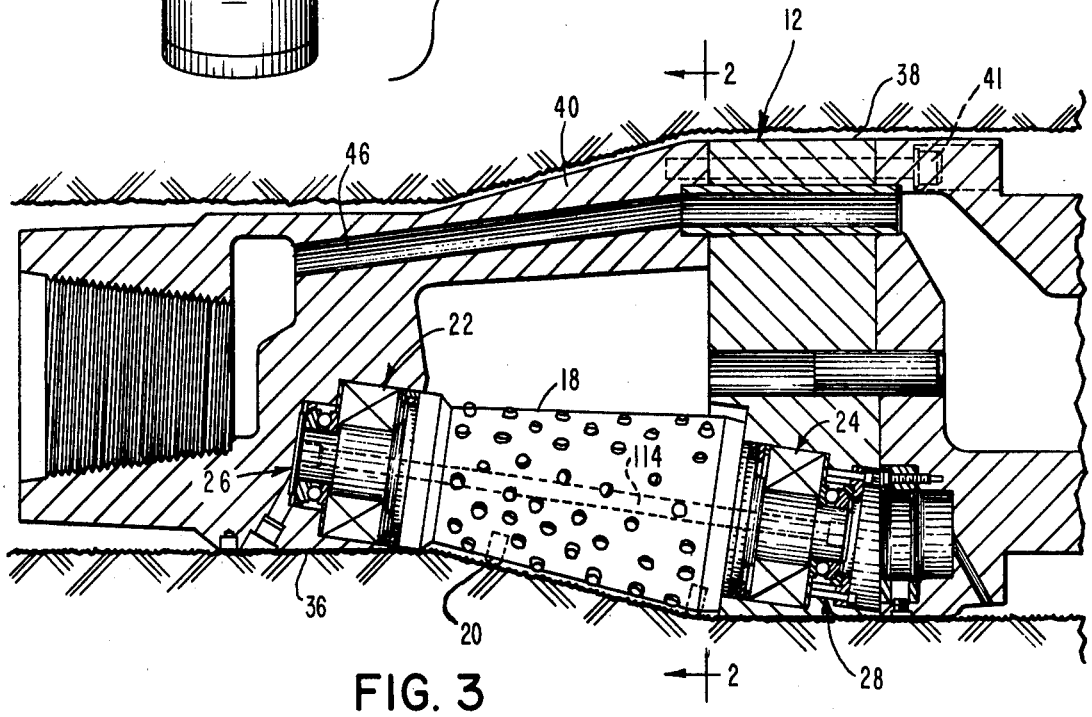
FIG. 3 is a sectional view taken along the lines 3—3 in FIG. 2.

In the embodiment of the invention illustrated in the drawings, FIG. 1 shows a self-advancing rotary conical boring tool 10 for reaming a pilot hole drilled in a rock formation. Conical boring tool 10 comprises a frame 12 having a plurality of roller cutters 18, typically three in number, circumferentially disposed about the centerline of the boring tool. A plurality of teeth 20, for example tungsten carbide teeth, are disposed randomly about the periphery of each cutter 18. Preferably, the Monte Carlo technique is used to provide absolute random spacing of teeth 20. As shown in FIG. 3, each roller cutter 18 is constrained with a pair of self-aligning spherical roller bearings 22 and 24 for free rotation about an axis that is both oblique and skewed with respect to a longitudinal axis of frame 12. A pair of thrust bearings 26 and 28 are mounted to the ends of roller bearings 22 and 24, respectively, for supporting axial thrust loads on the cutters.

Figure 5:
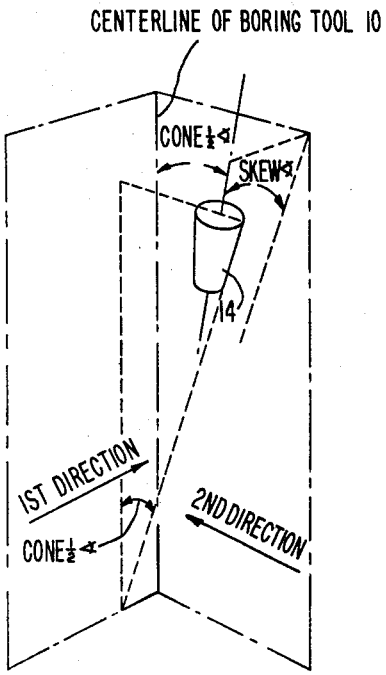
FIG. 5 is a schematic drawing illustrating certain principles of the invention.

As graphically illustrated in FIG. 5, the position of each cutter 18 relative to the centerline of boring tool 10 is described by a cone half angle and a skew angle. The cone half angle is the angle formed between the longitudinal axis of the boring tool and a longitudinally extending facial line of the roller cutter most removed from the tool centerline when viewed from a first direction and the skew angle is the angle formed between the longitudinal axis of the boring tool and the longitudinal axis of the roller cutter when viewed from a second direction that is at right angles to the first direction. Typically, the cone half angle is in the range of 12° to 20°, and preferably is 18°. The skew angle typically is in the range of 2° to 6°, and preferably is 4°.

In operation, a rotary drive unit 30, for example a blast hole drill, is connected to one end of a drill pipe 32, the other end of which is secured to an adaptor 34 that is fastened to frame 12. Rotary drive unit 30 is operative to rotate conical boring tool 10 in a first direction, for example a clockwise direction. As the conical boring tool rotates in the clockwise direction, roller cutters 18 rotate in an opposite or counterclockwise direction. The position of each roller cutter 18, as hereinbefore described, is such that conical boring tool 10 is self-advancing as the roller cutters rotate and teeth 20 engage the sidewalls of the pilot hole. The details of conical boring tool 10 are shown in FIGS. 2, 3, and 4.

Figure 2:
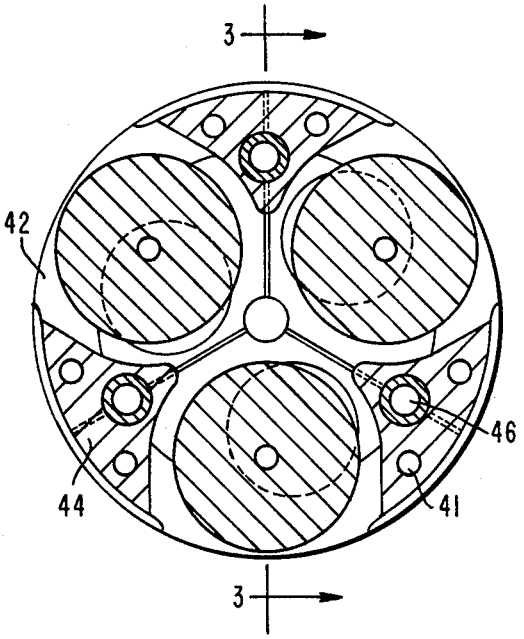
FIG. 2 is a sectional view taken along the lines 2—2 in FIG. 3.
Figure 4:
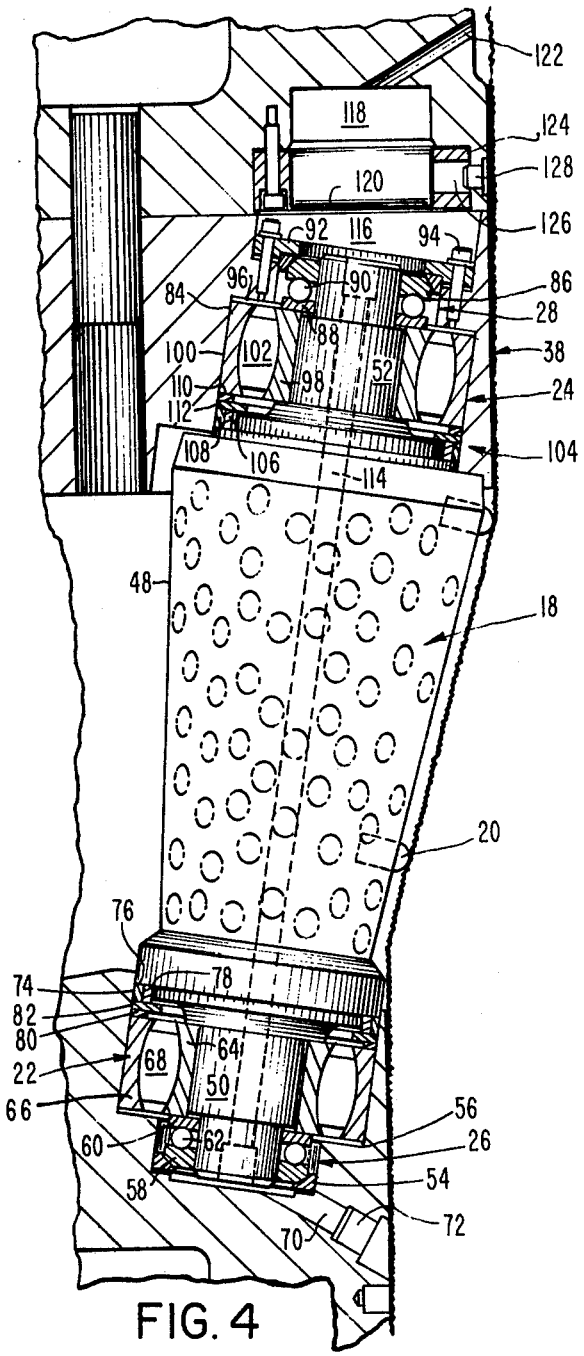
FIG. 4 is a side elevation, partly in section, of a roller cutter mounting assembly.

Referring now to FIGS. 2, 3 and 4, it will be seen that frame 12 has a substantially frusto-conical profile in right cross section and includes a lower cylindrical section 36, an upper cylindrical section 38 and a medial section 40 that is tapered outwardly from lower section 36 towards upper section 38. Lower section 36 and tapered medial section 40 constitute an integral structure and upper section 38 defines a separate transistional member which is mounted to medial section 40 by means of bolts 41. In the illustrated embodiment, by way of example, the diameter of transistional member 38 is approximately 36.8 cm and the diameter of lower section 36 is approximately 17.8 cm. Tapered medial section 40 is provided with recesses 42, each of which is configured to receive one roller cutter 18. The regions of medial section 40 between adjacent recesses 42 constitutes struts 44, each of which has a substantially triangular profile in right cross section. A bore 46 having, for example, a 2.5 cm inch diameter extends longitudinally through each strut 44 and defines a passage through which a flushing fluid is carried to the lower end of boring tool 10. Typically, the flushing fluid is air, or is a mixture of air and water, or is recirculated drilling mud, or is a mixture of recirculated drilling mud and air.

Each roller cutter 18 includes a frusto-conical body 48 from which teeth 20 project outwardly beyond the exterior surface of each strut 44 for engagement with the sidewall of the pilot hole. Stub shafts 50 and 52 extend from opposite ends of body 48 coaxial with the longitudinal axis thereof. Stub shaft 50 extends from the lower or narrow end of body 48 and stub shaft 52 extends from the upper or wide end of body 48. Preferably, stub shafts 50 and 52 are integral with frusto-conical body 48.

Stub shaft 50 is journaled in thrust bearing 26 and roller bearing 22 which are constrained within a seat 54 provided in frame 12 at lower section 36, roller bearing 22 being carried on a shoulder 56 of seat 54. Thrust bearing 26 includes a lower race 58 and an upper race 60 which retain ball bearings 62. Roller bearing 22 includes an inner race 64 and an outer race 66 which are configured to retain roller bearings 68. A lubricant, such as grease, is applied to thrust bearing 26 and roller bearing 22 through a duct 70 which is fitted with a plug 72. A seal 74, which includes an outer piston ring 76 and an inner piston ring 78, is provided for keeping foreign matter such as dirt from reaching roller bearing 22 and thrust bearing 26. A spacer ring 80 abuts the upper face of roller bearing 22. A wave spring 82 is sandwiched between spacer ring 80 and seal 74.

Stub shaft 52 is journaled in thrust bearing 28 and roller bearing 24 which are constrained within a seat 84 provided in transitional section 38 of frame 12. Thrust bearing 28 includes an upper race 86 and a lower race 88 which retain ball bearings 90. A bearing retainer 92, which is mounted to transitional section 38 by means of screws 94, captively holds thrust bearing 28. An upper face of roller bearing 24 abuts a shoulder 96 of seat 84. Roller bearing 24 includes an inner race 98 and an outer race 100 that are configured to retain roller bearings 102, the upper face of inner race 98 pressed against the lower face of lower race 88 of thrust bearing 28. A seal 104, which includes an inner piston ring 106 and an outer piston ring 108 that are pressed against the upper face of roller cutter 18, is provided for keeping foreign matter such as dirt from reaching roller bearing 24 and thrust bearing 28. A spacer ring 110 abuts the lower face of outer race 100. A wave spring 112 is sandwiched between spacer ring 110 and seal 104.

As shown in FIGS. 3 and 4, a coaxial passage 114, formed in roller cutter 18 and stub shafts 50 and 52, is provided for carrying grease from duct 70 to a cavity 115 above thrust bearing 28. A flexible diaphragm 120 is captively held to adaptor 34 and separates cavity 115 into chambers 116 and 118. A vent 122 extends from the exterior surface of adaptor 34 into chamber 118. Flexible diaphram 120, which is composed of an elastomer such as fabric reinforced neoprene rubber, is held by a retainer 124 that is mounted to adaptor 34. Chamber 116 is filled with a lubricant such as grease through a duct 126 which is fitted with a plug 128. Flexible diaphram 120 constitutes a pressure compensating member that is operative to confine grease in the roller bearings and thrust bearings and to keep foreign matter out of the bearings. When conical boring tool 10 is reaming a pilot hole, the exterior of the tool is exposed to an increase in pressure due to the flushing fluid and cuttings. This increase in pressure is present at the upper face of diaphram 120 which communicates with the exterior face of frame 12 via vent 70. In consequence, flexible diaphram 120 is pushed inwardly of chamber 116 until the pressure within chamber 116, i.e., internal pressure of roller cutter 18, is equal to the pressure in chamber 118, i.e., external pressure about boring tool 10. That is, diaphram 120 flexes until there is equal pressure on its opposite faces. Without such pressure compensation, the build up of external pressure would result in foreign matter entering the bearings and causing premature failure.

Figure 6A:
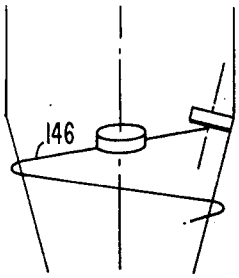
FIGS. 6A, 6B and 6C are schematic drawings illustrating certain principles of the invention.
Figure 6B:
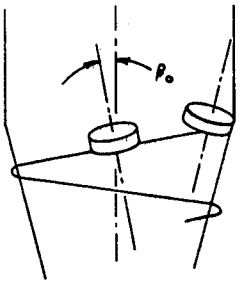
Figure 6C:
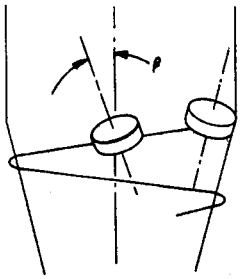

As previously indicated, each roller cutter 18 is constrained for free rotation about its longitudinal axis which is both oblique and skewed with respect to the longitudinal axis of boring tool 10. The orientation of roller cutters 18 provides a self-advancing action as the conical boring tool is rotated. The skew angle at which the roller cutters are disposed is greater than the neutral skew angle. If the skew angle is zero, as shown in FIG. 6A, the locus of the contact point of the teeth and rock defines a helix 146 as the roller cutters rotate and advance. If the roller cutters are skewed at an angle $\beta°$, which corresponds to the angle of helix 146 or neutral skew angle as illustrated in FIG. 6B, the roller cutters experience pure rolling. In the present invention, the roller cutters are disposed at a skew angle $\beta$, shown in FIG. 6C. Skew angle $\beta$ is greater than skew angle $\beta°$ and the roller cutters experience a rearward skidding motion as they contact the rock. In consequence, the cutters attempt to roll ahead in advance of the boring tool and provide a self-advancing action.

In one example of operation, blast hole drill rotates conical boring tool 10 in a clockwise direction and roller cutters 18 rotate in a counterclockwise direction as they engage the sidewalls of the pilot hole. Although the roller cutters are subjected to extreme conditions of stress as they chip-away and ream the pilot hole, spherical roller bearings 22 and 24 self adjust to compensate for any misalignment of shafts 50 and 52. The self-adjusting configuration of spherical roller bearings 22 and 24 prevents premature failure of the spherical roller bearings. That is, spherical roller bearings 22 and 24 are maintained in an aligned position relative to stub shafts 50 and 52, respectively, although the stub shafts and their associated roller cutters 18 are displaced by stress produced during the cutting operation. Thrust bearings 26 and 28 support axial load thrust presented on roller cutters 18 and constitute secondary bearing members on which the roller cutters rotate. In other words, spherical roller bearings 22, 24 define primary bearings and thrust bearings 26, 28 define secondary bearings.

Since certain changes may be made in the foregoing disclosure without departing from the scope of the invention herein described, it is intended that all matter contained in the above description and depicted in the accompanying drawings be construed in an illustrative and not in a limiting sense.

What is claimed is:

1. A self-advancing conical boring tool comprising:

(a) a tapered frame formed with a plurality of circumferentially disposed recesses;

(b) a pair of thrust bearings mounted within each of said recesses;

(c) a pair of self-aligning spherical roller bearings mounted within each of said recesses, one of each said roller bearings abutting one of each said thrust bearings;

(d) pressure compensating means mounted to said frame adjacent one of said thrust bearings, said frame formed with a cavity about at least one of said thrust bearings, said pressure compensating means separating said cavity into at least two chambers, one of said chambers communicating with said thrust bearing, the other of said chambers communicating with an exterior surface of said frame;

(e) a roller cutter supported in each said pair of spherical roller bearings and each said pair of thrust bearings, each said roller cutter having a frusto-conical body, stub shafts extending from said body, a longitudinal axis of said body coaxial with a longitudinal axis of said shafts, one of said stub shafts received in one of said spherical roller bearings pair and one of said thrust bearing pair, the other of said stub shafts received in the other of said spherical roller bearing pair and the other of said thrust bearing pair;

(f) each said roller cutter constrained within each said pair of thrust bearings and each said pair of spherical roller bearings for free rotation about an axis that is both oblique and skewed relative to a longitudinal axis of said frame.

2. A self-advancing conical boring tool comprising:

(a) a tapered frame formed with a plurality of circumferentially disposed recesses;

(b) a pair of thrust bearings mounted within each of said recesses;

(c) a pair of self-aligning spherical roller bearings mounted within each of said recesses, one of each said roller bearings abutting one of each said thrust bearings;

(d) a roller cutter supported in each said pair of spherical roller bearings and each said pair of thrust bearings, each said roller cutter having a frusto-conical body, stub shafts extending from said body, a longitudinal axis of said body coaxial with a longitudinal axis of said shafts, one of said stub shafts received in one of said spherical roller bearings pair and one of said thrust bearing pair, the other of said stub shafts received in the other of said spherical roller bearing pair and the other of said thrust bearing pair;

(e) each said roller cutter constrained within each said pair of thrust bearings and each said pair of spherical roller bearings for free rotation about an axis that is both oblique and skewed relative to a longitudinal axis of said frame;

(f) said frame formed with a cavity about at least one of each said pair of thrust bearings, a vent formed in said frame communicates with each said cavity, one end of each said vent opened at an exterior wall of said frame, a flexible diaphram mounted in each said cavity between said one of each said thrust bearing and the other end of each said vent, each said flexible diaphram separating said cavity into a pair of chambers, one of said chambers communicating with said one thrust bearing and the other of said chambers communicating with said vent.

3. The conical boring tool as claimed in claim 1 wherein each said roller cutter is provided with a plurality of projecting teeth randomly disposed about the periphery of said frusto-conical body.

4. The conical boring tool as claimed in claim 1 wherein said axis about which each said roller cutter rotates is at a cone half angle and a skew angle, said cone half angle being an angle formed between the longitudinal axis of said frame and a longitudinally extending facial line of said roller cutter most removed from said tool centerline when viewed from a first direction, said skew angle being an angle formed between the longitudinal axis of said frame and the longitudinal axis of said roller cutter when viewed from a second direction that is at right angles to said first direction.

5. The conical boring tool as claimed in claim 3 wherein said cone half angle is in the range of 12° to 20° and said skew angle is in the range of 2° to 6°.

6. A self-advancing conical boring tool comprising:

(a) a tapered frame formed with a plurality of circumferentially disposed recesses;

(b) a pair of bearing means mounted within each of said recesses, a cavity formed between at least one of each said bearing means pair and said frame;

(c) a pressure compensating member mounted within each said cavity, each of said pressure compensating members separating said cavity into distinct chambers, one of said chambers communicating with said one of said bearing means pair, a vent communicating with an exterior face of said frame and another of said chambers;

(d) a roller cutter supported in each said pair of bearing means, each said roller cutter having a wide upper portion and a narrow lower portion constituting a frusto-conical body, shaft means extending from opposite ends of said body, a longitudinal axis of said body coaxial with a longitudinal axis of said shaft means, one end of said shaft means received in one of said bearing means of each said bearing means pair, an opposite end of said shaft means received in the other of said bearing means of each said bearing means pair, a longitudinally extending passage formed in said body and said shaft means; and (e) a plurality of teeth projecting outwardly from the periphery of each said roller cutter body 7. The conical boring tool as claimed in claim 6 wherein each said bearing means pair includes a pair of spherical roller bearings and a pair of thrust bearings, one end of said shaft means journaled in one of said roller bearings and one of said thrust bearings, the other end of said shaft means journaled in the other of said roller bearing and said thrust bearing, said roller bearings intermediate said thrust bearings and said body.

8. The conical boring tool as claimed in claim 7 wherein said pressure compensating member is a flexible diaphram.

9. The conical boring tool as claimed in claim 8 wherein said teeth are disposed randomly about the periphery of each said body.

10. A self-advancing rock boring tool for reaming a pilot hole in a rock formation, said tool comprising:

(a) a tapered frame formed with at least one circumferentially disposed recess;

(b) a roller cutter supported in each said recess, each said roller cutter including a substantially frusto-conical body having a plurality of projecting teeth randomly disposed about its periphery for engaging the rock formation, a shaft extending from opposite ends of said body;

(c) a pair of self-aligning spherical roller bearings and a pair of thrust bearing, one end of said shaft journaled in one of said roller bearings and one of said thrust bearings, the other end of said shaft journaled in the other of said roller bearings and the other of said thrust bearings, said one roller bearing disposed between said one thrust bearing and one end of said body, said other roller bearing disposed between said other thrust bearing and an opposite end of said body, said body constrained for free rotation about an axis that is both oblique and skewed relative to a longitudinal axis of said frame;

(d) a pressure compensating member forming a chamber adjacent one of said thrust bearings, one wall of said chamber being one face of said pressure compensating member, a vent communicates with an opposite face of said pressure compensating member and an exterior wall of said tool; and (e) drive means operatively connected to said frame for rotating said frame in a first direction, each said roller cutter rotating in a second direction when said teeth contact the rock formation, said first direction opposite said second direction.

11. The conical boring tool as claimed in claim 10 wherein said roller cutter rotational axis is disposed at a cone half angle and a skew angle, said cone half angle formed between the longitudinal axis of said frame and a longitudinally extending facial line of the roller cutter most removed from said tool centerline when viewed from a first direction, said skew angle formed between the longitudinal axis of said frame and the longitudinal axis of said roller cutter when viewed from a second direction that is at right angles to said first direction.

12. The conical boring tool as claimed in claim 10 wherein said frame includes an upper section, a lower section and a medial section, said lower section and said medial section constituting an integral member, said upper section constituting a separate transistional member.

13. The conical boring tool as claimed in claim 12 wherein one of said roller bearings and one of said thrust bearings is mounted to said integral member, the other of said roller bearings and the other of said thrust bearings mounted to said transitional member.

* * * * *